US005205024A

United States Patent [19]

Willard

[11] Patent Number: 5,205,024

[45] Date of Patent: Apr. 27, 1993

[54] INK TACK WITH ENHANCED VIAL PROTECTION

[75] Inventor: Alan E. Willard, Coral Springs, Fla.

[73] Assignee: Sensormatic Electronics Corporation, Deerfield Beach, Fla.

[21] Appl. No.: 937,593

[22] Filed: Aug. 31, 1992

[51] Int. Cl.[5] ..... A44B 9/00

[52] U.S. Cl. ..... 24/704.1; 70/57.1

[58] Field of Search ..... 24/704.1, 704.2, 711.4, 24/711.5; 70/57.1; 340/572

[56] References Cited

U.S. PATENT DOCUMENTS

| | | | |
|---|---|---|---|
| 4,483,049 | 11/1984 | Gustavsson et al. | 70/57.1 |
| 4,944,075 | 7/1990 | Hogan | 70/57.1 X |
| 5,054,172 | 10/1991 | Hogan et al. | 70/51.1 X |
| 5,088,165 | 2/1992 | Minasy et al. | 70/57.1 X |

*Primary Examiner*—James R. Brittain

*Attorney, Agent, or Firm*—Robin, Blecker, Daley & Driscoll

[57] ABSTRACT

A housing assembly for a theft-deterrent tack comprises a housing, at least one frangible vial containing a theft-deterrent substance disposed in the housing and a displaceable member supported by the housing for movement therein to cause fracture of the vial and for concurrently opening a theretofore closed portion of the assembly for egress of the theft-deterrent substance. The displaceable member has a first end portion, an opposed second end portion and an intermediate portion, the first end portion being in an interference movement path with the vial. The housing has a bounding surface having an opening therethrough, the displaceable member second end portion being resident in the housing bounding surface opening when the displaceable member is in non-fracturing relation to the vial. The displaceable member defines a passage therethrough opening into both of the first and second end portions thereof. A pin is disposed in the passage and, together with a locking member applied to a pin free end distal from the housing, is operative to secure the housing assembly to a garment to be protected.

16 Claims, 3 Drawing Sheets

INK TACK WITH ENHANCED VIAL PROTECTION

FIELD OF THE INVENTION

This invention relates generally to so-called "ink tags" or "ink tacks", as defined below, providing a deterrent to article theft and pertains more particularly to enhanced protection of ink tag or tack vials from fracture in tag or tack handling.

BACKGROUND OF THE INVENTION

A wide variety of patented approaches to ink tags is presently known, most having in common the containment of a theft-deterrent substance in one or more frangible containers, e.g., tubes or vials comprised of glass or rigid plastic disposed in a housing of the tag. The housing is secured to the article to be protected by attachment structure of a type which is releasable upon use of specialized release devices by authorized personnel.

Predecessor devices to ink tags which employed frangible tubes involved, as the article protected, bank vaults or safes. These devices taught two modes of vial fracturing, which have carried over into the ink tag designs.

In a first mode, evidenced in Loehle U.S. Pat. No. 4,299,176, a pin passes through the vial container, free of contact with the vials, to a rear side of the vial container, where the pin is secured by a locking device. The pin has vial-fracturing discs associated therewith in opposed facing relation to the vials. Efforts to attack the protected article which result in movement of the pin cause compressive fracture of the vials between the discs and the expelling of theft-deterrent substance therefrom In a second mode, evidenced also in the Loehle patent, attacks upon the integrity of the vial-containing compartment impart fracturing forces to the vials, without reliance on pin movement as the cause of vial fracture.

Known ink tags involving the first fracture mode include, e.g., Hogan U.S. Pat. No. 4,944,075 and Hogan et al. U.S. Pat. No. 5,054,172.

In the '075 patent, balls are provided between a pinhead and ink-containing vials and guide channels are formed in the device for movement of the balls, the channels being configured for enabling the pinhead to force the balls into rupturing engagement with the vials upon excess separating force being applied as between the pinhead and its locking member.

In the '172 patent, a pinhead includes a breaker element having a contoured surface for applying rupturing force to the vials upon excess separating force being applied as between the pinhead and its locking member. In use of either described ink tag, the housing containing the vials is secured to one side of an article to be protected by passing the pin therethrough and a locking member secures the pin therein on the opposite side of the article.

One known ink tag involving the second fracture mode in a first setting, wherein the attack on the vial housing is the imposition of force thereon, is set forth in Charlot et al. U.S. Pat. No. 5,031,287. In the '287 patent, the vial-containing housing has structure giving rise to ready flexure in a plurality of predetermined housing-flexure directions as opposed to other flexure directions and individual vials are disposed in alignment respectively with the easier flexure directions, whereby it is said that a vial fractures upon the housing being subjected to flexing in any one of the predetermined housing-flexure directions, as might occur in an attempt to remove the housing from its locking member.

Other prior art ink tag patents involving the second fracture mode in such first setting include Wisecup U.S. Pat. No. 4,670,950, Heaton et al. U.S. Pat. No. 4,649,397 and Gustaffson et al. U.S. Pat. No. 4,483,049. Substance-dispensing openings, e.g., apertures extending into the housings and in communication with the vials, are common in these ink tags.

The second fracture mode is also known in a second setting, wherein the attack on the vial housing is, as in the Loehle patent, an attack on the integrity of the housing. Apt references here include Marshall U.S. Pat. No. 4,698,620 and Freed U.S. Pat. No. 4,603,326. The devices of these patents contrast with the devices involving the second fracture mode in the first setting in that the housing is not provided with substance-dispensing openings until the point of deterioration of the housing integrity.

The more desirable ink tags, from a practical viewpoint, as respects both manufacturing efficiency and use-effectiveness, are the ink tags of the first fracture mode.

However, as alluded to above, all of the above-referenced theft-deterrent devices of the first fracture mode (and of the second fracture mode, first setting type) have a common problem, i.e., exposure of the contained vials to the possibility of fracture in normal handling through the insertion of objects into fracturing engagement therewith through the requisite theft-deterrent substance-dispensing openings. Thus, each of the devices of these ink tags has an opening or a series of openings in its housing requisite for issuing the deterrent substance on theft attempts. The problem is recognized particularly in the referenced Charlot et al. '287 patent where structure is said to be provided for recessing the vials from such issuance openings. Although not discussed as such in the '287 patent, the above-noted Gustavsson '049 patent will be seen to likewise recess its vials from the issuance openings.

The assignee hereof has long provided the industry with electronic article surveillance (EAS) tags, i.e., tags which incorporate means responsive to incident energy to transmit alarm-indicating signals to remote apparatus to thereby generate alarm indication on efforts to unauthorizedly separate the tags from articles to which the tags are applied. Such EAS tags have also been equipped with means for themselves outputting alarm indication on such unauthorized separation efforts. The assignee has also provided the industry with what it terms "ink tacks", i.e., devices attachable to articles for ink dispensing on such unauthorized separation efforts, and has afforded the industry further products which combine the EAS capacity and the ink dispensing capacity, by adapting the ink tack for joinder with the EAS tag, a common locking member affixing both such components to the article to be protected. Thus, the invention herein, specific to the ink dispensing structure, is termed an "ink tack". Various of the above discussed prior art devices incorporate both ink dispensing and EAS facilities, but the distinction as between tag and tack is not recognized in the prior art.

SUMMARY OF THE INVENTION

The present invention has as its primary object the provision of improved ink tacks of the first fracture mode.

A particular object of the invention is to provide enhanced protection of theft-deterrent substance-containing vials from exposure to undesired fracture in normal handling of housings containing the vials.

A more specific object of the invention is to provide an improved ink tack wherein ink-containing vials are so encased as to preclude entry of objects into the vial-containing housing but, nonetheless, to provide the requisite issuance opening on demand.

In attaining these and other objects, the invention provides a housing assembly for a theft-deterrent tack comprising a housing, at least one frangible vial containing a theft-deterrent substance disposed in the housing and a displaceable member supported by the housing for movement therein to cause fracture of the vial and for concurrently opening a theretofore closed portion of the assembly for egress of the theft-deterrent substance.

The displaceable member has a first end portion, an opposed second end portion and an intermediate portion, the first end portion being in an interference movement path with the vial to cause vial fracture.

In a preferred embodiment, the housing has a bounding surface thereof having an opening therethrough, the displaceable member means first end portion being resident in the housing bounding surface opening when the displaceable member is in non-fracturing relation to the vial.

The displaceable member defines a passage therethrough opening into both of the first and second end portions thereof. A pin is disposed in the passage and, together with a locking member applied to a pin free end distal from the housing, is operative to secure the housing assembly to a garment to be protected.

The foregoing and other objects and features of the invention will be further understood from the following detailed description of a preferred embodiment thereof and from the drawings, wherein like reference numerals identify like components throughout.

DESCRIPTION OF PREFERRED EMBODIMENTS AND PRACTICES

Figure 2:
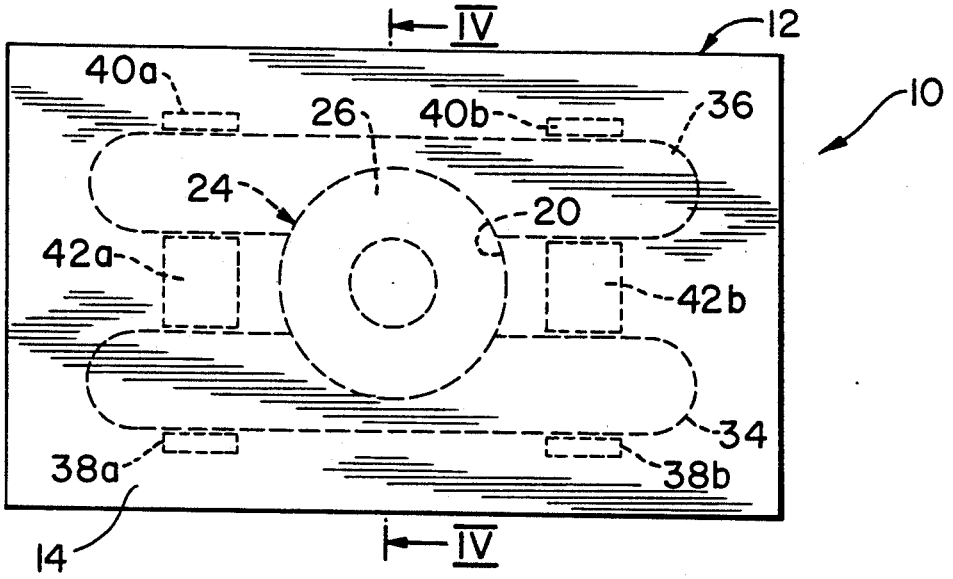
FIG. 2 is a top plan view of the FIG. 1 tack housing assembly, with certain components, discussed below, shown in phantom.
Figure 1:
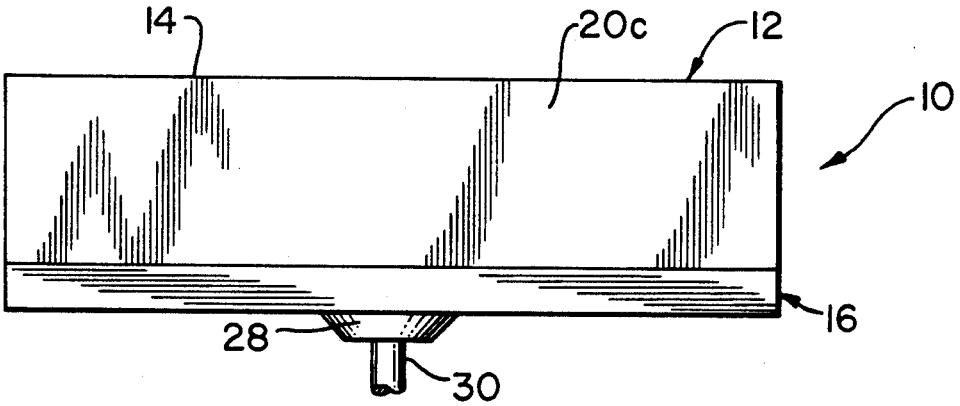
FIG. 1 is a front elevation of an ink tack housing assembly in accordance with the invention.
Figure 3:
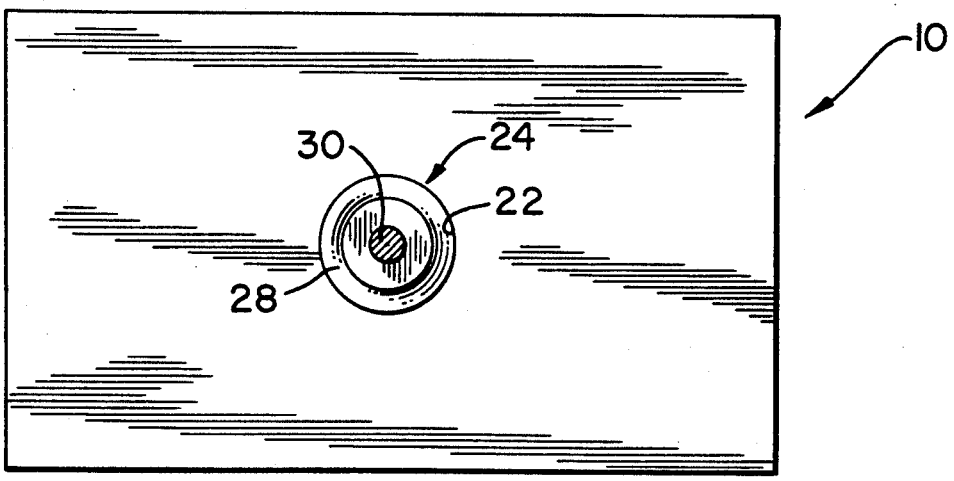
FIG. 3 is a bottom plan view of the FIG. 1 housing assembly.
Figure 4:
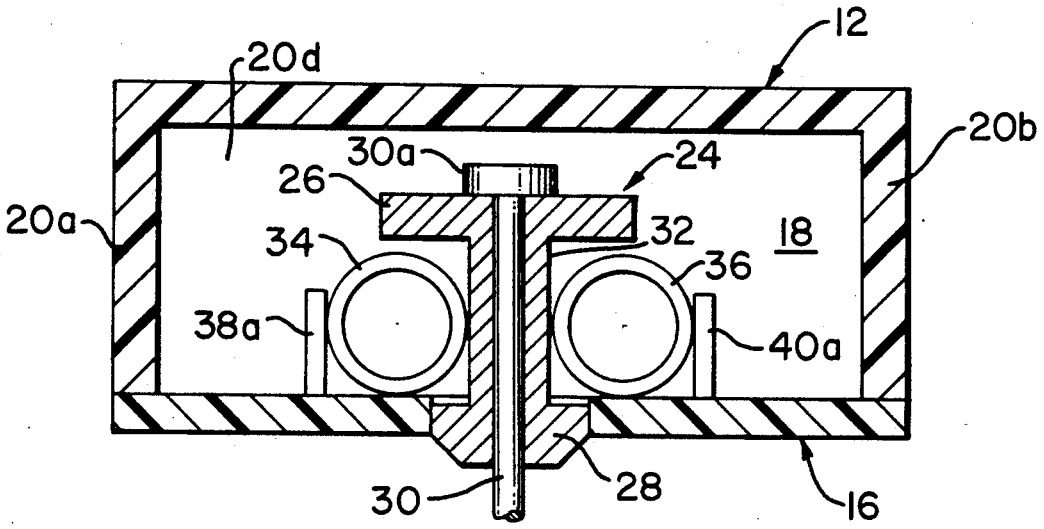
FIG. 4 is a sectional view of the FIG. 1 housing assembly as would be seen from plane IV—IV of FIG. 2.

Referring to FIGS. 1–6, tack housing assembly 10 includes an upper or first housing 12 with ceiling 14 and a lower or second housing 16, the housings both preferably comprised of molded plastic and suitably secured to one another by an adhesive or heat-induced sealing. Housing 12 defines an open interior and, with housing 16 secured thereto, the resulting housing assembly defines compartment 18.

Figure 6:
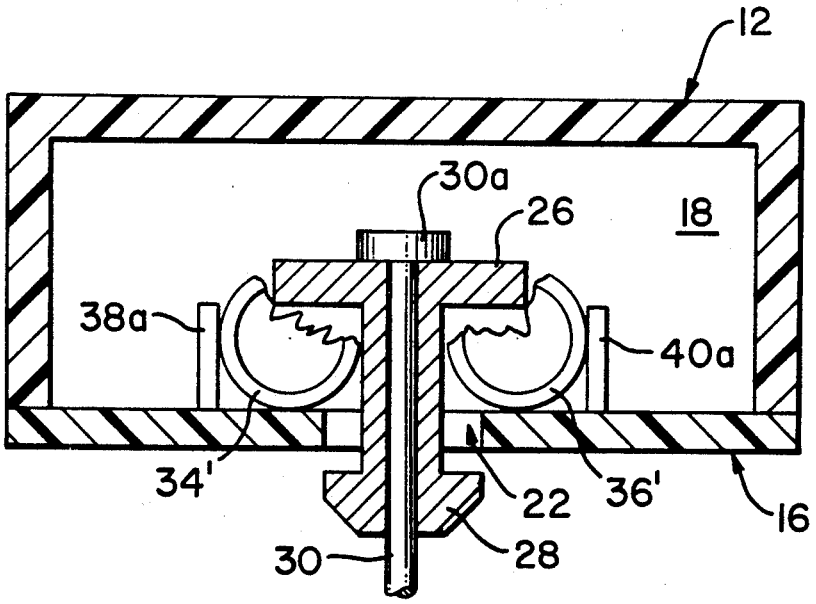
FIG. 6 is a repeat showing of FIG. 4, indicating the housing condition on an effort at unauthorized separation of the tack from the garment.
Figure 5:
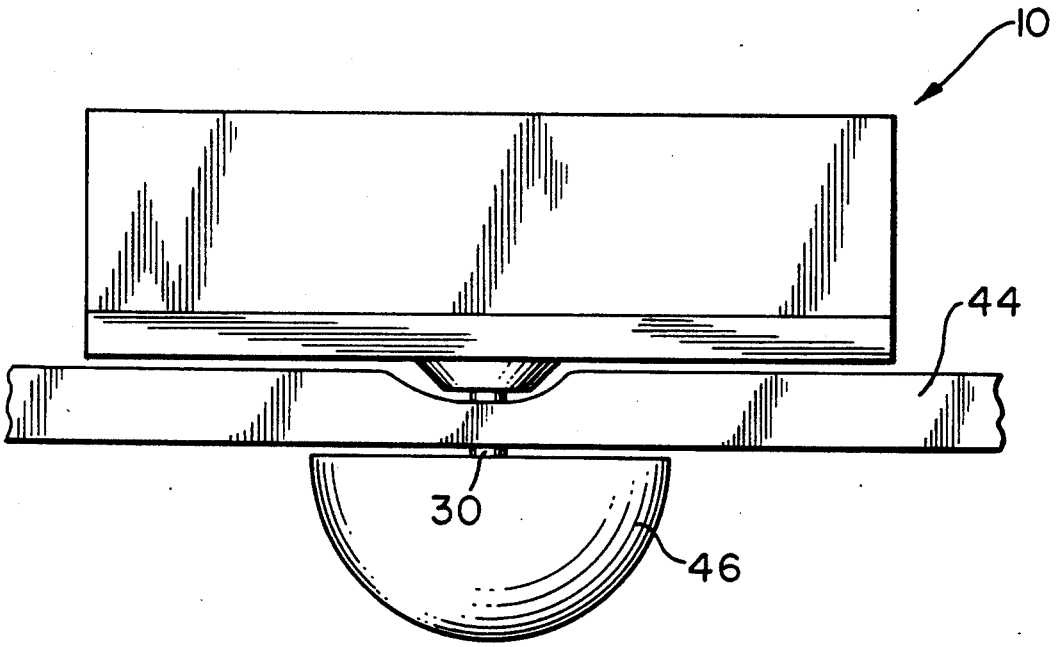
FIG. 5 is a repeat showing of FIG. 1 with the ink tack housing thereof assembled with a garment and having a locking member in place to retain the housing with the garment.

Ceiling 14 of housing 12 and sidewalls **20*a*–20*d* are continuous, i.e., without openings therethrough (FIG. 6). Housing 16, on the other hand, defines an opening 22 therethrough. Displaceable member 24 has an upper portion 26 disposed in compartment 18 and a lower portion 28 which seats in opening 22** and normally closes the same.

Displaceable member 24 defines a passage extending throughout upper portion 26, lower portion 28 and intermediate portion 32 thereof and pin 30 is seated in the passage, a head **30*a* of the pin bearing on upper portion 26. Vials 34 and 36, each containing a theft-deterrent substance, e.g., ink, are disposed in compartment 18**. The vials are constituted by a frangible material, such as glass or a rigid plastic material.

Housing 16 has outer guides **38*a*, 38*b* and 40*a*, 40*b* (FIGS. 2, 4 and 6) and inner guides 42*a* and 42*b* (FIG. 2) formed therewith and upstanding in compartment 18 to position vials 34 and 36 in vertical interference path with upper portion 26 of displaceable member 24**.

Tack housing assembly 10 is assembled with an article 44 to be protected against theft by forcing pin 30 through the article and applying locking member 46 to the pin on the underside of the article. Locking member 46 may be of type shown in commonly assigned U.S. Pat. No. 3,995,900, to which incorporating reference is hereby made.

The assembly of the tack housing assembly, article 44 and locking member 46 will tolerate normal tagged article handling, without vial-rupturing displacement of member 24. Thus, vials 34 and 36 are so constituted as to retain their structural integrity and not fracture with upper portion 26 of member 24 in moderately changing pressure influence therewith.

However, on the application of force exceeding such moderately changing pressure influence to the assemblage, i.e., as would occur when a person endeavors to unauthorizedly separate the assembly, displaceable member 24, more particularly, upper portion 26 thereof will force vials 34 and 36 respectively against intermediate portion 32 thereof, outer guides **38*a*, 38*b* and 40*a*,40*b*, inner guides 42*a* and 42*b* and housing 16 to an extent giving rise to compressive fracture of the vials, with member 24 translating in such fracture to its disposition shown in FIG. 6. In such disposition of member 24, it will be seen that opening 22, theretofore closed, becomes open and provides a path for the dispensing of the theft-deterrent substance from the fractured vials 34' and 36' outwardly of compartment 18, through opening 22, onto article 44. The vials are shown in fractured condition in FIG. 6 as broken vials 34' and 36'**.

Displaceable member 24 will be seen as analogous to a valve spool and housing 16 will be seen to define a valve seat for the valve spool, whereby opening 22 is a valved opening.

While the foregoing described embodiment shows immediate engagement of upper portion 26 of displaceable member 24 with the vials for fracture thereof, the invention of course contemplates structure additional thereto and separate therefrom, e.g., the balls movable by the displaceable member, as in the referenced Hogan U.S. Pat. No. 4,944,075, as the vial-fracturing structure.

Incorporating reference is accordingly made to the '075 patent.

As will be appreciated from the foregoing and by way of introduction to the ensuing claims, the invention will be seen to provide a housing assembly for a theft-deterrent tack comprising a housing, at least one frangible vial containing a theft-deterrent substance disposed in the housing and displaceable means supported by the housing for movement therein to cause fracture of the vial and for concurrently opening a theretofore closed portion of the assembly for egress of the theft-deterrent substance. The displaceable means has a first end portion, an opposed second end portion and an intermediate portion, the first end portion being in an interference movement path with the vial. The housing has a bounding surface having an opening therethrough, the displaceable means second end portion being resident in the opening when the displaceable means is in non-fracturing relation to the vial.

The displaceable means defines a passage therethrough opening into both of the first and second end portions thereof. The housing is comprised of a first housing member defining an open-ended compartment for receiving the vial. The housing further comprises a second housing member defining the housing bounding surface having the arore-mentioned opening and secured to the first housing member and closing the open ended compartment. The second housing member includes positioning means for disposing the vial in preselected position in the housing assembly.

Otherwise viewed, the invention provides a theft-deterrent tack for application to an article comprising a housing assembly for a theft-deterrent tack comprising a housing, at least one frangible vial containing a theft-deterrent substance disposed in the housing and a displaceable member supported by the housing for movement therein to fracture the vial and for concurrently opening a theretofore closed portion of the assembly for egress of the theft-deterrent substance and means for securing the housing assembly to an article to be protected.

It will be further appreciated from the foregoing that the invention provides a theft-deterrent tack comprising a first component including a housing having an open end and ceiling and wall structure bounding an interior space extending to the open end, the ceiling and wall structure being continuous throughout, a second housing secured to the first housing and closing the interior space except for an opening extending therethrough into the interior space, a valve spool disposed in the tack, the valve spool having an end portion closing such opening and a passage therethrough, at least one frangible vial disposed in the first housing in interference path with the valve spool, and a second component securing the first assembly to an article to be protected, and a pin member disposable in the valve spool passage to have an end extending through the article, and a second component comprising a locking member for releasably engaging an end of the pin member, the valve spool being displaceable on efforts to separate the assemblage and thereby to fracture the vial and thereupon creating a passage in the second housing to dispense the theft-deterrent substance from the vial.

Various changes in structure to the described tack housing and assembly may evidently be introduced without departing from the invention. Accordingly, it is to be understood that the particularly disclosed and depicted embodiment is intended in an illustrative and not in a limiting sense. The true spirit and scope of the invention is set forth in the following claims.

What is claimed is:

1. A housing assembly for a theft-deterrent tack comprising a housing, at least one frangible vial containing a theft-deterrent substance disposed in the housing and displaceable means supported by the housing for movement therein to cause fracture of the vial and for concurrently opening a theretofore closed portion of the assembly for egress of the theft-deterrent substance.

2. The invention claimed in claim 1 wherein the displaceable means has a first end portion, an opposed second end portion and an intermediate portion, the first end portion being in an interference movement path with the vial.

3. The invention claimed in claim 2 wherein the housing has a bounding surface having an opening therethrough, the displaceable means second end portion being resident in the housing bounding when the displaceable means is in non-fracturing relation to the vial.

4. The invention claimed in claim 3 wherein the displaceable means defines a passage therethrough opening into both of the first and second end portions thereof.

5. The invention claimed in claim 4 wherein the housing is comprised of a first housing member defining an open-ended compartment for receiving the vial.

6. The invention claimed in claim 5 wherein the housing further comprises a second housing member defining the housing bounding surface and secured to the first housing member and closing the open ended compartment.

7. The invention claimed in claim 6 wherein the second housing member includes positioning means for disposing the vial in preselected position in the housing assembly.

8. A theft-deterrent tack for application to an article comprising:

(a) a housing assembly for a theft-deterrent tack comprising a housing, at least one frangible vial containing a theft-deterrent substance disposed in the housing and displaceable means supported by the housing for movement therein to fracture the vial and for concurrently opening a theretofore closed portion of the assembly for egress of the theft-deterrent substance; and (b) means for securing the housing assembly to the article.

9. The invention claimed in claim 8 wherein the displaceable means has a first end portion, an opposed second end portion and an intermediate portion, the first end portion being in an interference movement path with the vial.

10. The invention claimed in claim 9 wherein the housing has a bounding surface an opening therethrough, the displaceable means second end portion being resident in the housing bounding surface opening when the displaceable means is in non-fracturing relation to the vial.

11. The invention claimed in claim 10 wherein the displaceable means defines a passage therethrough opening into both of the first and second end portions thereof.

12. The invention claimed in claim 11 wherein the housing is comprised of a first housing member defining an open-ended compartment for receiving the vial.

13. The invention claimed in claim 12 wherein the housing further comprises a second housing member defining the housing bounding surface and secured to the first housing member and closing the open ended compartment.

14. The invention claimed in claim 13 wherein the second housing member includes positioning means for disposing the vial in preselected position in the housing assembly.

15. A theft-deterrent tack comprising:

a) a first component including 1) a first housing having an open end and ceiling and wall structure bounding an interior space extending to the open end, the ceiling and wall structure being continuous, 2) a second housing secured to the first housing and closing the interior space except for an opening extending therethrough into the interior space, 3) a valve spool disposed in the tack, the valve spool having a first end portion, a second end portion closing the second housing opening and a passage therethrough, 4) at least one frangible vial disposed in the first housing in interference path with the valve spool; and b) a second component including securement means for securing the first component to an article to be protected.

16. The invention claimed in claim 15, wherein said securement means comprises a pin member disposable in the valve spool passage to have an end exteriorly of the first component and a locking member for releasably engaging the pin member end.

* * * * *